US008684213B1

(12) United States Patent
White

(10) Patent No.: US 8,684,213 B1
(45) Date of Patent: Apr. 1, 2014

(54) USER-FRIENDLY, CHILD-RESISTANT CONTAINER

(76) Inventor: Andrew White, Fort Myers, FL (US)

( * ) Notice: Subject to any disclaimer, the term of this patent is extended or adjusted under 35 U.S.C. 154(b) by 0 days.

(21) Appl. No.: 13/618,747

(22) Filed: Sep. 14, 2012

(51) Int. Cl.
*B65D 17/52* (2006.01)
*B65D 43/26* (2006.01)

(52) U.S. Cl.
CPC ..... *B65D 43/267* (2013.01)
USPC ..... 220/284; 81/3.39; 81/3.37

(58) Field of Classification Search
CPC ..... B65D 43/267; B65D 43/265; B65D 43/26
USPC ..... 215/304, 303, 302, 295, 241, 240, 239, 215/238, 237, 235, 215, 216; 81/3.39, 3.37, 81/3.36, 3.49, 3.48, 3.47, 3.55
IPC ..... B65D 17/52
See application file for complete search history.

(56) References Cited

U.S. PATENT DOCUMENTS 2,237,528 A * 4/1941 Marasso ..... 220/816

* cited by examiner

*Primary Examiner* — Robert J Hicks
(74) *Attorney, Agent, or Firm* — Westerman, Hattori, Daniels & Adrian, LLP

(57) ABSTRACT

A container assembly that includes a container having a container top and a container floor, a lid affixed to said container top by a hinge, the lid being adapted to move between an open position and a closed position, an internal fastener being (1) attached to the inside of the container, (2) not accessible from the outside of the container when the lid is in its closed position, and (3) adapted to maintain the lid in its closed or locked position, an access hole in the container floor, a lever positioned within the container and above the access hole, and a tool adapted to be inserted into the access hole to activate the lever to release the internal fastening mechanism.

15 Claims, 9 Drawing Sheets

USER-FRIENDLY, CHILD-RESISTANT CONTAINER

FIELD OF THE DISCLOSURE

There is a need for containers that are readily opened by adults, including older or infirm adults, but is not practically accessible by small children.

SUMMARY OF THE DISCLOSURE

Disclosed is a user-friendly, child-resistant container assembly. It comprises a container having a container top and a container floor, an access hole in the container floor, a lid affixed to the container top by a hinge and adapted to move between an open position and a closed position. The container assembly also includes an internal fastener that is (1) attached to the inside of the container, (2) not accessible from the outside of the container when the lid is in its closed position, and (3) adapted to maintain the lid in its closed position. In some embodiments a lever is positioned within the container and above the access hole. The assembly may also include. a tool adapted to be inserted into the access hole, activating the lever and releasing the internal fastening mechanism. In other embodiments, there is an access hole in the lid, so that a tool may enter container and release the internal fastening mechanism.

It is quite difficult for a small child to open the container. On the other hand, even an adult with arthritic hands can readily open the container with the tool.

DETAILED DESCRIPTION OF THE DISCLOSURE

The preferred embodiment of the present disclosure is a pill container 1. Other embodiments include any type of container where it is desirable that a small child not have access, but that an adult, in position of both the container and the tool, have ready access even if the adult suffers from any sort of immobility of the fingers or hands, such as arthritis.

Figure 1:
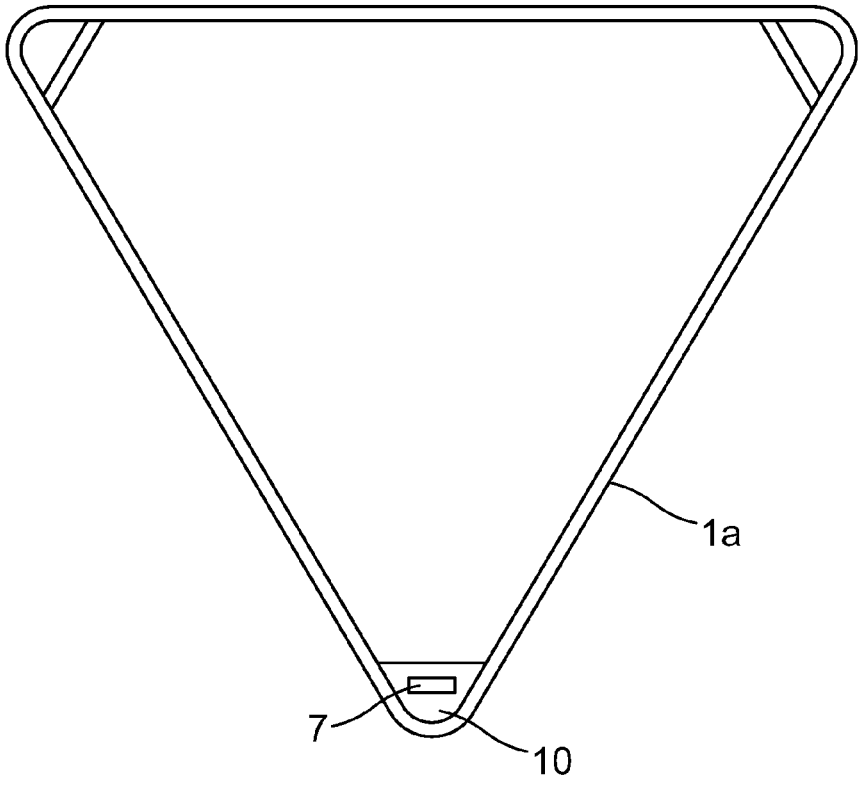
FIG. 1 is a bottom view of the container floor.

The container 1 may have substantially any general size and shape, dictated primarily by the intended contents of the container, for instance pills. The container 1 may be circular, oval or elliptical in cross-section. In certain preferred embodiments it has three vertical sides 1*a* as in FIG. 1, more preferably four sides, most preferably three sides. The container also has a top area 2 and a bottom 3, i.e., a floor 3.

Affixed by a hinge 4 to the top 2 of the container 1 is a lid 5 which moves between open and closed position, allowing one to open and close the container. The term hinge 4 is to be broadly understood, encompassing any structure that holds the lid 5 to the container 1 and yet allows movement of the lid 5 so that the container 1 may be accessed. Moreover, there may be multiple hinges 4, two being preferred.

The term lid 5 is also to be broadly understood encompassing any desired shape or size that may be used to close the top of the container 1 and moved to an open position to allow access to the inside of the container 1. In a preferred embodiment, the lid 5 is a flat triangle corresponding to the preferred contained shape having three sides shown in FIGS. 4-5 and 7-9. Of course, other lid 5 and container 1 shapes and combinations thereof are possible.

Figure 3A:
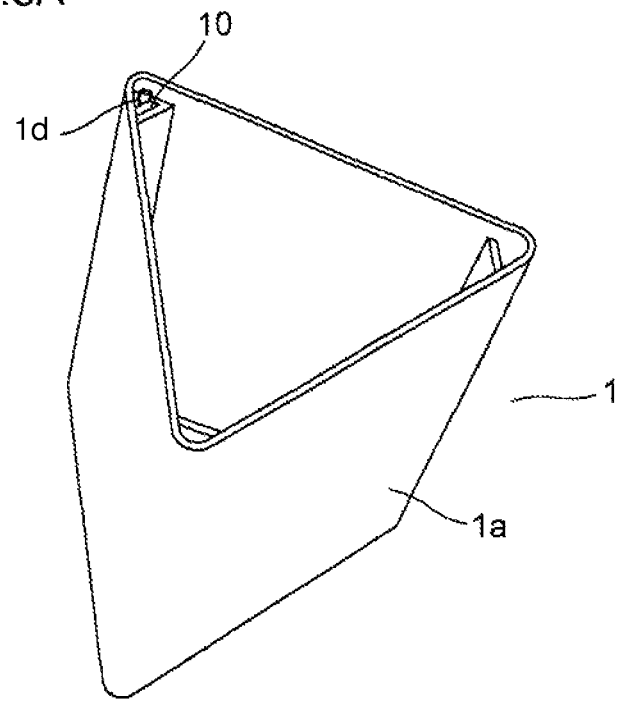
FIGS. 3A and 3B are perspective views of the container top and bottom respectively.
Figure 3B:
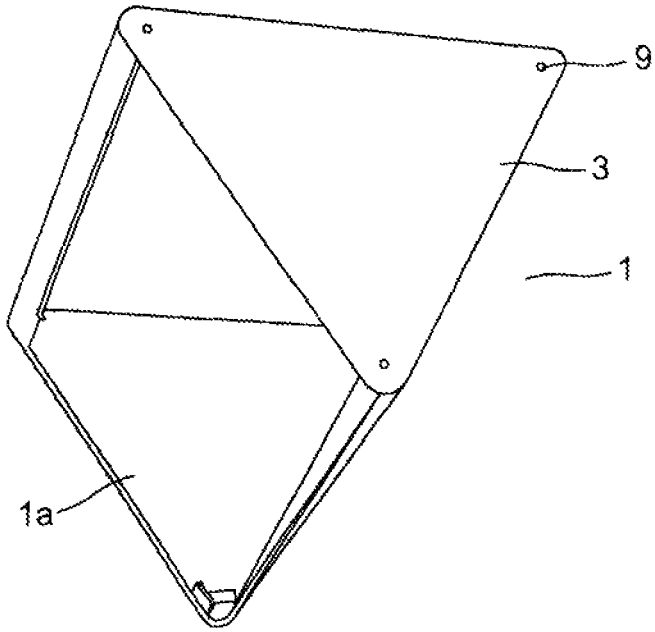
Figure 4:
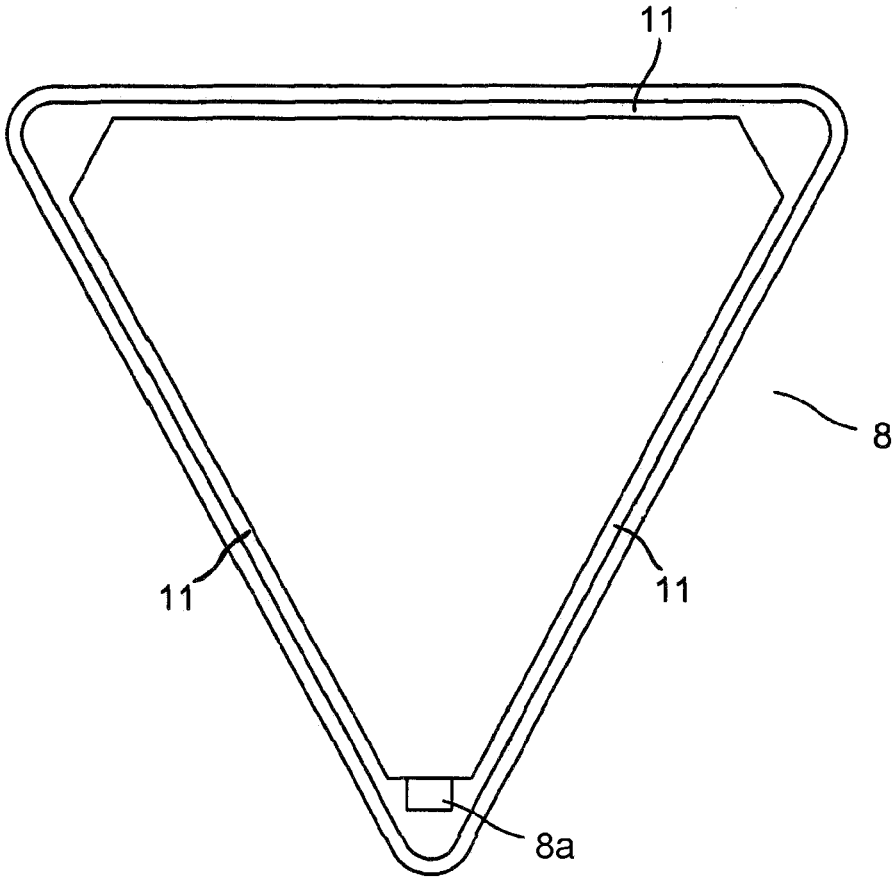
FIG. 4 is a top view of the tool.
Figure 5:
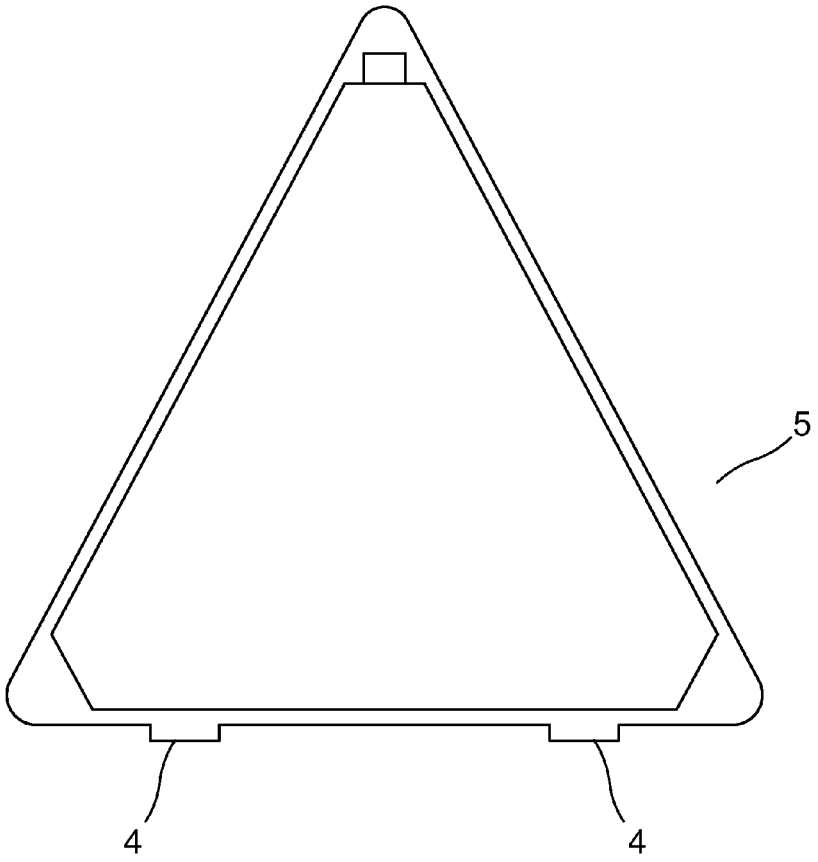
FIG. 5 is a top view of the lid.
Figure 6A:
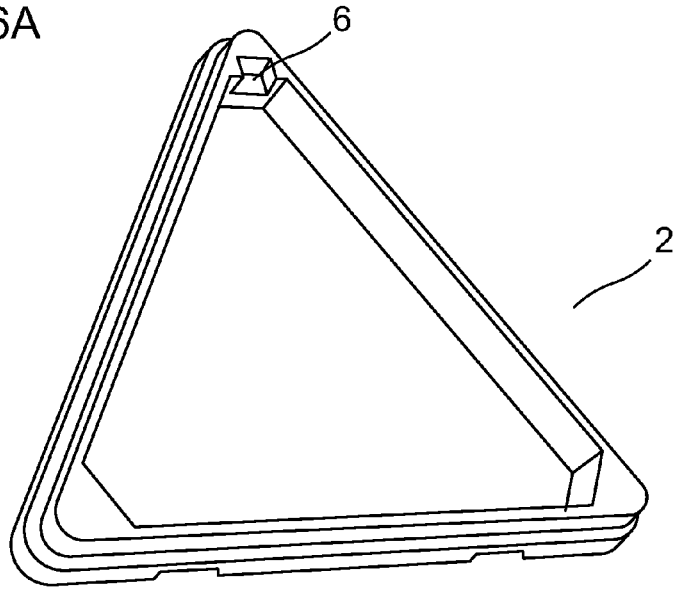
FIGS. 6A and 6B are perspective views of the lid.
Figure 6B:
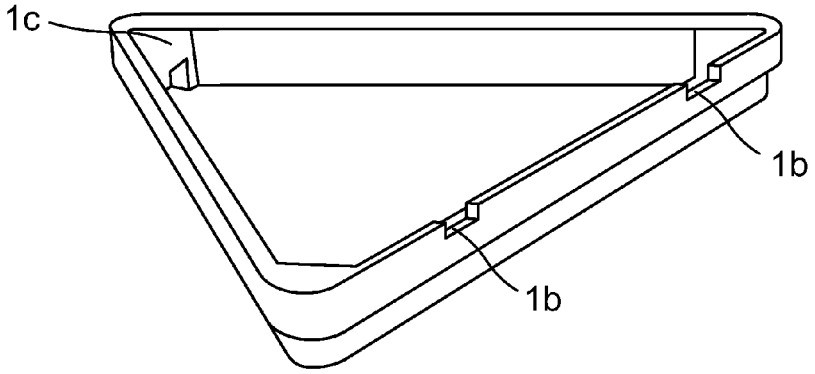
Figure 7:
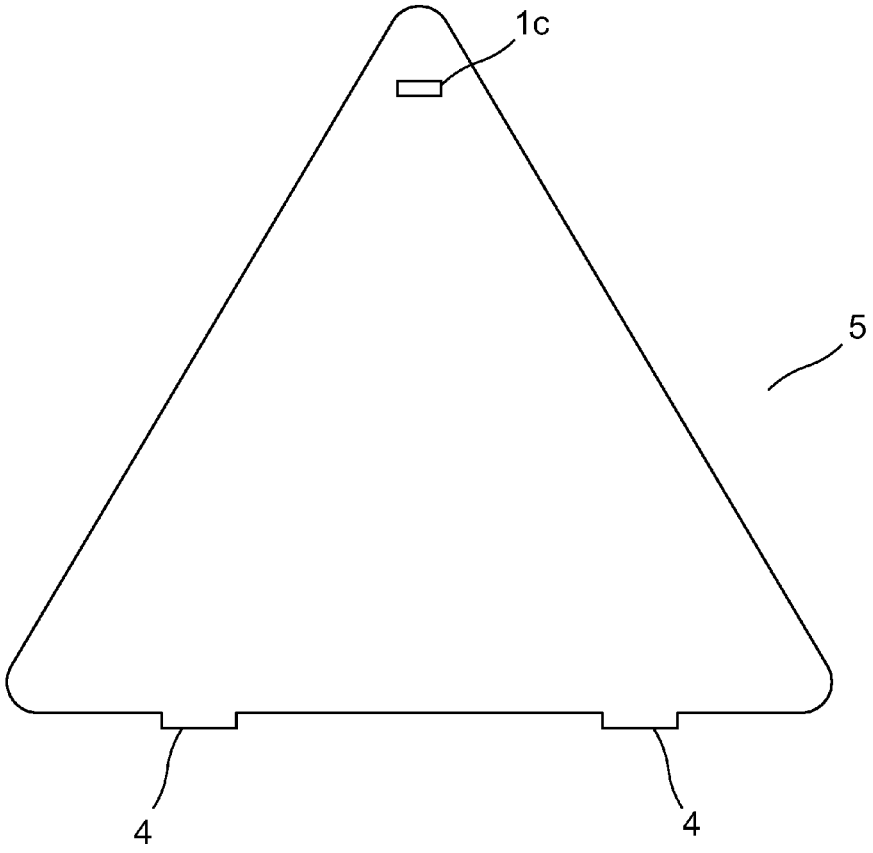
FIG. 7 is a bottom view of the lid.
Figure 8:
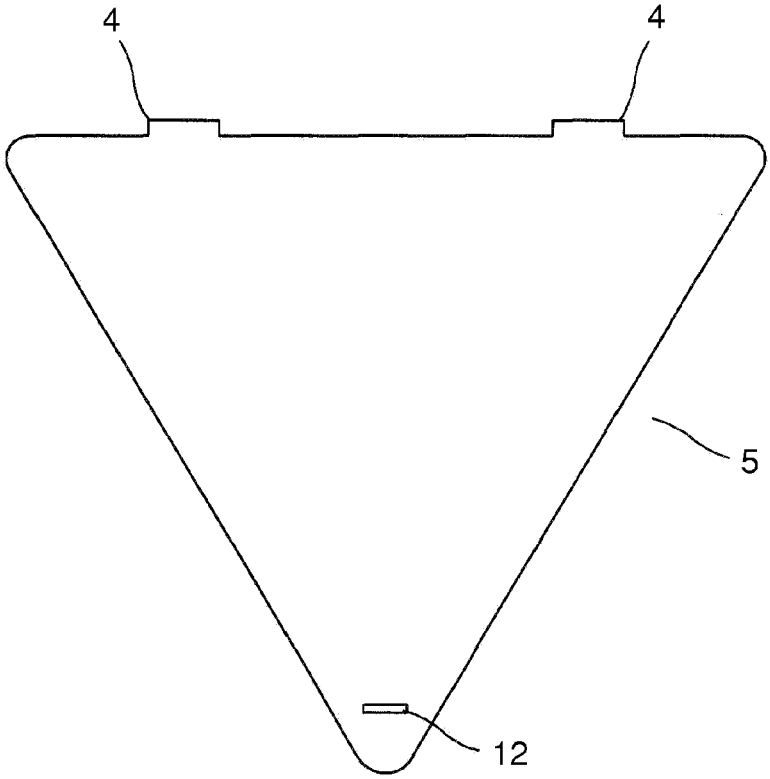
FIG. 8 is a top view of the lid.
Figure 9:
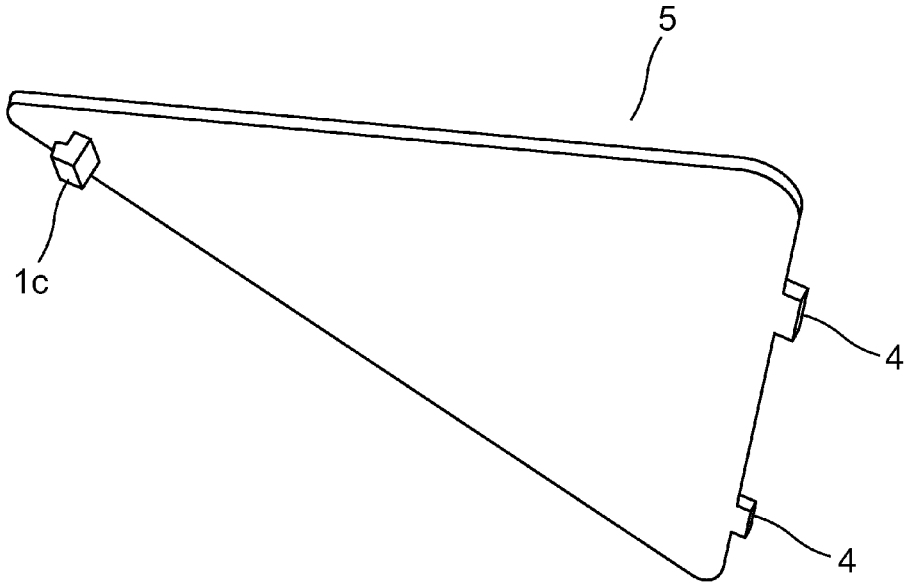
FIG. 9 is a perspective view of the lid.

Looking at FIGS. 3A and 3B, an internal fastening mechanism 1*d* is used to maintain the lid 5 in its closed position, and in some embodiments, it is located at the opposite side of the lid 5 from the hinge 4. The internal fastener 1*b* may be located inside of the container 1, where it is not accessible from the outside of the container 1 when the lid 5 is in its closed position. Suitable design choices, such as a clasp, a snap, a hook, etc., for the internal fastener 1*b* will be evident to those skilled in the art from present disclosure. In the closed or locked position, the internal fastener 1*b* engages a fastener projection 1*c* of lid 5.

Figure 2:
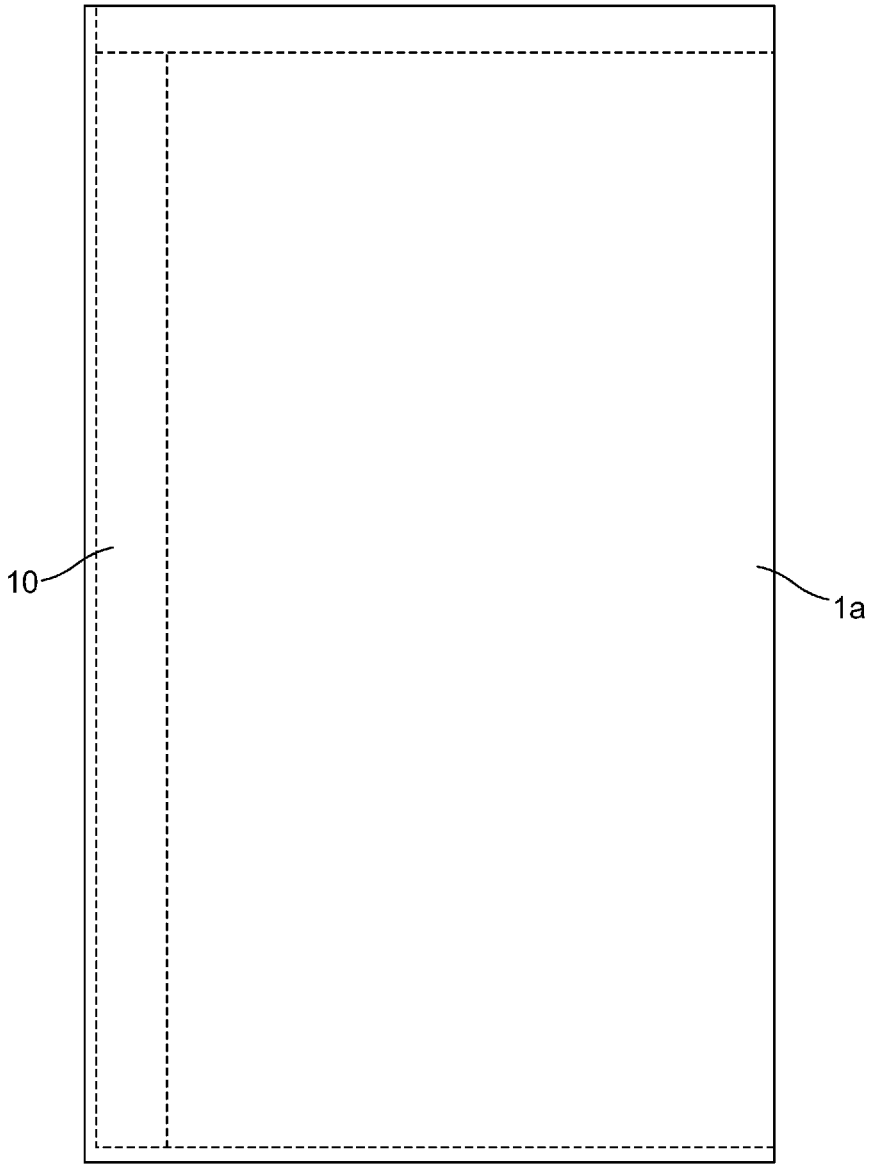
FIG. 2 is a side view of a vertical container side.

In the floor 3 is an access hole 9 (FIG. 3B) through which a tool 8 may enter the inside of the container. A lever 7 is housed within the container and above an access hole 9, so that the lever 7 is engaged, either directly or indirectly, by the tool 8 when the tool 8 enters the container 1 through the access hole 9. The lever 7 then engages, either directly or indirectly, the internal fastener 6, causing it to move from a closed position toward an open position. The lever 7, in some embodiments, is housed within a vertical lever shaft 10 as in FIGS. 1, 2 and 3A.

In preferred embodiments, the tool is in the shape of a base on or in which the container may be lodged or cradled. In some embodiments, the inner periphery of the tool 8 includes a ledge portion 11 on which the container may sit. In some embodiments, the shape of the tool 8 roughly corresponds to the shape of the container 1, for instance, a triangular cross-section of the tool 8 corresponds to a triangular cross-section of the container 1. In some embodiments, a projection 8*a* of the tool 8 extends vertically from the tool 8; it is aligned with the access hole 9, for engagement with the lever 7, as mentioned above. The projection 8*a* may be integral with the tool or may be a separate component.

The bottom of the container may contain non-access holes or recesses 12, adapted to receive knobs or similar projecting structures on the tool, to assist one to position the container on or in the tool.

In some embodiments, there is a lid access hole 12 in the lid, and a tool adapted to be inserted into the lid access hole 12 of the lid 5 (FIG. 8) to release the internal fastening mechanism 1*b*.

The invention claimed is:

1. A user-friendly, child-resistant container assembly, comprising a container having a container top and a container floor, a lid affixed to said container top by a hinge, said lid being adapted to move between an open position and a closed position, an internal fastener being (1) attached to the inside of the container, (2) not accessible from the outside of the container when the lid is in its closed position, and (3) adapted to maintain the lid in its closed position, an access hole in the container floor, a lever positioned within said container and above said access hole, and a tool adapted to be inserted into the access hole to activate the lever to release an internal fastening mechanism.

2. The container assembly of claim 1, further comprising a vertical lever shaft positioned within said container and above said access hole, wherein said lever positioned within said vertical lever shaft.

3. The container assembly of claim 1, wherein said container further comprises at least three vertical container sides, each of said vertical container sides being joined to two other vertical container sides, and each of said vertical container sides having a top portion and a bottom portion, wherein said container floor joins the bottom portions of the at least three vertical container sides.

4. The container assembly of claim 3, wherein said floor comprises at least three base sides, said vertical base sides being joined to two other base sides, and each of said vertical container sides having a top portion and a bottom portion.

5. The container assembly of claim 1, wherein said tool is in the shape of a base adapted so that said container may be lodged on said tool, and said tool comprising a vertical projection, and wherein when said container is lodged onto said tool, said access hole, said vertical lever shaft, and said lever are substantially in line, and said vertical projection is capable of urging said lever upward so that it engages said lid and causes said lid to move to its open position.

6. The container assembly of claim 3, further comprising a first non-access hole in the floor adjacent a second join between two of said vertical container sides and a second non-access hole adjacent a third join between two of said vertical container sides.

7. The container assembly of claim 1, wherein at least one of said sides is indirectly joined to at least one of the two other sides.

8. The container assembly of claim 1, wherein said lid is attached by the hinge to the top portion of said at least one vertical container side.

9. The container assembly of claim 1, further comprising a latch located on the top portion of one of the vertical container sides and adapted to engage said lid in its closed position.

10. The container assembly of claim 3, wherein there are four vertical container sides and four vertical base sides.

11. The container assembly of claim 1, wherein said lid is attached by at least two hinges to the top portion of said at least one vertical container side.

12. The container assembly of claim 1, wherein the container is adapted to hold pills, wherein said tool further comprises a support ridge that is adapted to support said container.

13. The container assembly of claim 1, wherein said lid in its closed position plugs an opening in the top of said container.

14. The container assembly of claim 1, wherein activation of the lever by the tool causes the movement of the lid toward its open position.

15. A user-friendly, child-resistant container assembly, comprising a container having a container top and a container floor, a lid affixed to said container top by a hinge, said lid being adapted to move between an open position and a closed position, an internal fastener being (1) attached to the inside of the container, (2) not accessible from the outside of the container when the lid is in its closed position, and (3) adapted to maintain the lid in its closed position, an access hole in the lid, a lever positioned within said container and below access hole, and a tool adapted to be inserted into the access hole of the lid to release an internal fastening mechanism.

* * * * *